US005641233A

United States Patent [19]

Wilson

[11] Patent Number: 5,641,233

[45] Date of Patent: Jun. 24, 1997

[54] BRUSH APPARATUS

[75] Inventor: Thomas E. Wilson, Solon, Ohio

[73] Assignee: Carson Specialty Products, Solon, Ohio

[21] Appl. No.: 372,555

[22] Filed: Jan. 13, 1995

[51] Int. Cl.[6] ..... A46B 11/04

[52] U.S. Cl. ..... 401/277; 401/288

[58] Field of Search ..... 401/277, 288

[56] References Cited

U.S. PATENT DOCUMENTS

| | | | |
|---|---|---|---|
| 469,990 | 3/1892 | Brewington | 401/277 |
| 1,226,163 | 5/1917 | Auld | 401/277 |
| 1,445,911 | 2/1923 | Rayder . | |
| 1,482,535 | 2/1924 | Woods . | |
| 1,671,122 | 5/1928 | Ormond . | |
| 1,810,074 | 6/1931 | Friedlander . | |
| 2,291,282 | 7/1942 | Hollenbeck . | |
| 2,669,740 | 2/1954 | Main | 401/277 |
| 2,698,452 | 1/1955 | Osrow . | |
| 2,922,178 | 1/1960 | Kelly . | |
| 3,123,259 | 3/1964 | Musel et al. . | |
| 3,896,822 | 7/1975 | Zimmerman | 401/277 X |
| 4,279,527 | 7/1981 | Moe et al. | 401/277 |
| 4,747,720 | 5/1988 | Bellehumeur et al. . | |
| 4,748,990 | 6/1988 | Brown et al. | 401/277 X |
| 4,773,572 | 9/1988 | Stull . | |
| 4,786,199 | 11/1988 | Chen . | |
| 5,066,157 | 11/1991 | Liff . | |

*Primary Examiner*—Steven A. Bratlie

*Attorney, Agent, or Firm*—Pearne, Gordon, McCoy & Granger

[57] ABSTRACT

A brush applicator for use with a container for a fluid product and the combination with a container with a dispensing opening for a fluid product. The dispensing opening may be a spout, and the brush applicator has a brush body with bristles and a cap for surrounding the dispensing opening. There are first threads on the container and second threads in the brush applicator with these threads part of a valve structure wherein the tightening of the threads effects a fluid seal between the cap and the dispensing opening, and loosening the threads allows variable fluid flow from the container into the brush applicator. The brush applicator being securable to the cap and being capable of being snapped on and off the container by deformation of at least one of the cooperating threads. A method of making the complete brush applicator is also disclosed by shipping only the caps to the manufacturer of the brush applicator. The foregoing Abstract is merely a resume of general applications, it is not a complete discussion of all principles of operation or applications, and is not to be construed as a limitation on the scope of the claimed subject matter.

6 Claims, 2 Drawing Sheets

BRUSH APPARATUS

BACKGROUND OF THE INVENTION

A number of prior patents have shown a fountain brush without any valve to close the container such as U.S. Pat. Nos. 1,671,122; 1,810,074; 2,291,282; and 2,922,178. Others do show a brush applicator and container with a valve for the fluid product. Yet, the valve is entirely within the container or within the brush applicator, such as, U.S. Pat. Nos. 1,482,535 and 2,698,452. Other patents showing dispensing containers with applicators include U.S. Pat. Nos. 4,747,720; 4,786,199; and 5,066,157. Other patents showing containers suitable for dispensing a fluid include U.S. Pat. Nos. 3,123,259 and 4,773,572.

SUMMARY OF THE INVENTION

The present invention is a brush applicator which is a melding of the type of cap and valve shown in U.S. Pat. No. 4,773,572 with a brush applicator to produce a snap-on, flow-through brush applicator that is part of the cap which regulates the flow of material from a squeeze bottle.

The invention also includes the concept of separation of the closure system of U.S. Pat. No. 4,773,572 into two distinct parts and then unifying the brush applicator with the conical section of the patented cap into a single part. This allows not only the flow-through squeeze bottle idea to work but also allows the user to regulate the flow and most importantly to turn off the flow entirely if desired.

Accordingly, the invention relates to a brush applicator for use with a container for a fluid product, the container having a dispensing opening with first threads, the brush applicator including a brush body having bristles; a cap for surrounding the dispensing opening and having a co-axial aperture to the bristles; second threads on the cap cooperable with the first threads as part of a valve structure which also includes the co-axial aperture cooperating with the dispensing opening, the tightening of the threads effecting a fluid seal between the cap and the dispensing opening, and loosening the threads separates the cap and dispensing opening sufficiently to allow variable fluid flow from the container into the brush applicator; said brush applicator being securable to said cap and the brush applicator being capable of being snapped on and off the container by deformation of at least one of said cooperating threads.

The invention is further defined by a brush applicator and container with a dispensing opening for a fluid product with the brush being usable as an applicator for the fluid product and the combination of the two providing an openable and closeable valve structure to dispense or seal off the flow of the fluid product; said valve structure including first and second cooperable valve parts; said first valve part including a dispensing opening cap having a coaxial aperture; cooperating threads on said first and second valve parts such that tightening of the threads effects a fluid seal between said cap and said dispensing opening, and loosening said threads separates said cap and said dispensing opening sufficiently to allow fluid flow from said container dispensing opening into said brush applicator; said brush applicator having bristles and having a second coaxial aperture therein for flow of fluid from said container to the interior of said brush bristles; said brush applicator being secured to said dispensing opening cap as a unit; and at least one of said cooperating threads being deformable, whereby said brush applicator and said dispensing opening cap as a unit may be snapped on and off the container at the dispensing opening.

The invention is further defined by the method of making a valved brush for a container which is closeable by a cap, comprising the steps of: taking delivery of just the caps from one of the manufacturer, distributor and wholesaler of the containers and caps therefor; manufacturing a brush body with brush bristles in one end and a cap recess in the other end; uniting a cap in the cap recess in each brush body; and shipping the brush body, with bristles and cap therein, to a purchaser.

Other objects and a fuller understanding of the invention may be had by referring to the following description and claims, taken in conjunction with the accompanying drawing.

DESCRIPTION OF THE PREFERRED EMBODIMENTS

Figure 1:
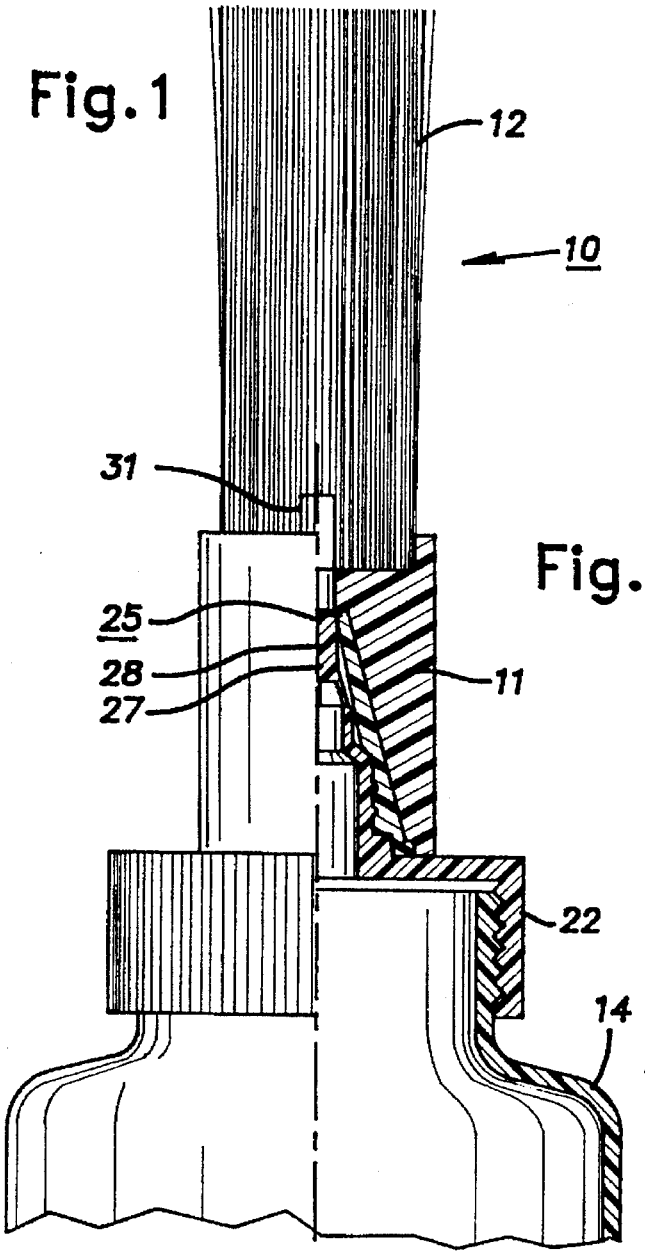
FIG. 1 is a longitudinal, sectional view of a brush applicator and container with a valve being closed.
Figure 2:
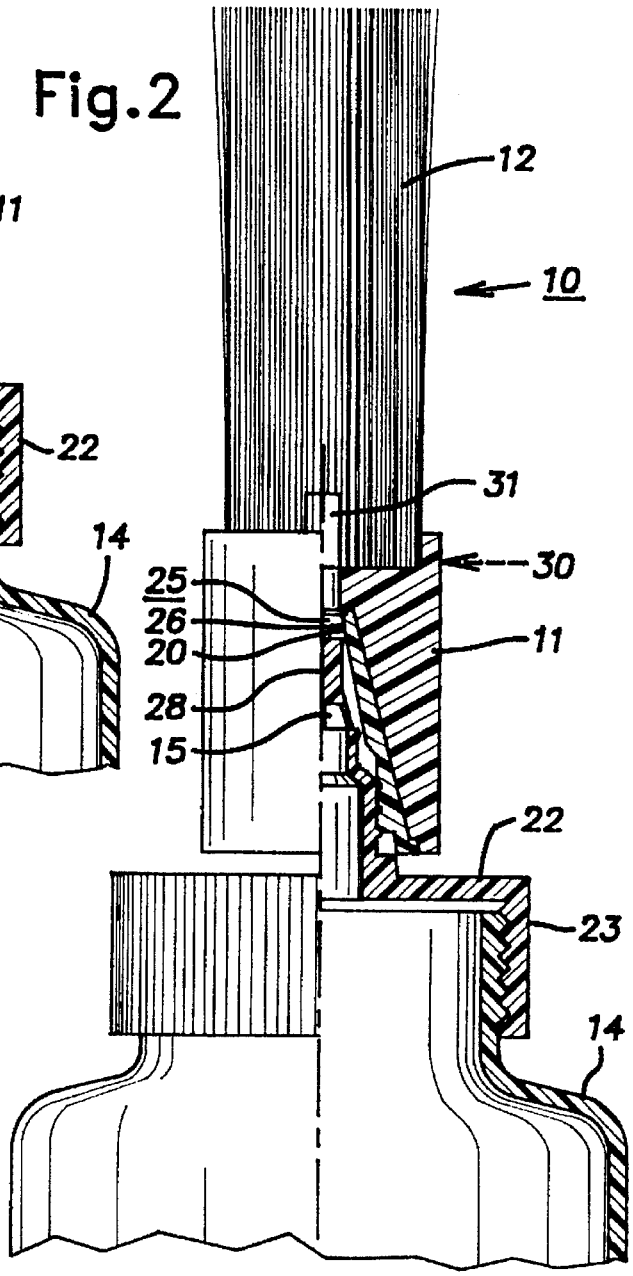
FIG. 2 is a similar longitudinal, sectional view of the brush applicator and container with the valve being opened.
Figure 4:
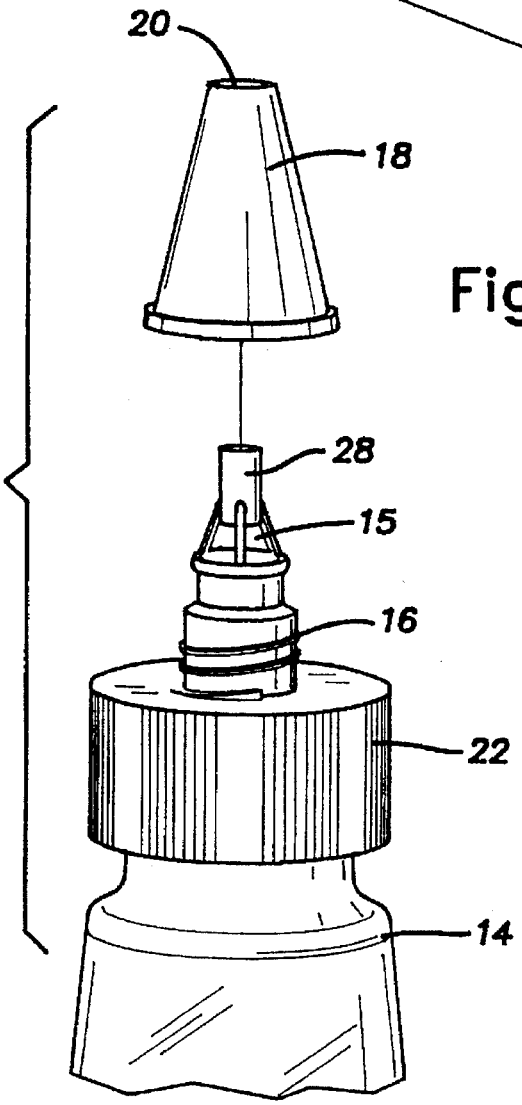
FIG. 4 is an isometric view of a cap being separated from a container for a fluid product.
Figure 5:
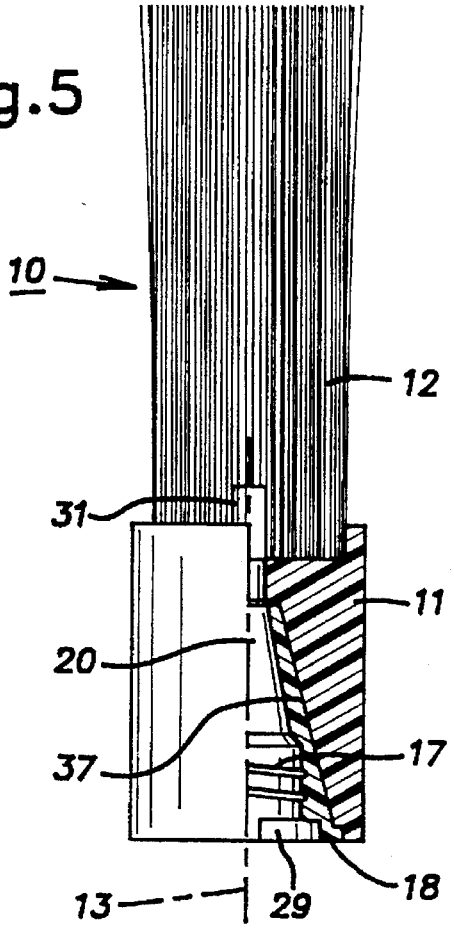
FIG. 5 is a longitudinal view partially in section of only the brush applicator.

FIG. 5 shows a brush applicator 10 which includes a brush body 11 with bristles 12 at one longitudinal end along an axis 13. This brush applicator is for use with a container 14, as shown in FIGS. 1, 2 and 4 with the container being for a fluid product. The container has a dispensing opening with first threads 16 which are external threads. These external threads are cooperable with second threads 17 which are internal threads on a cap 18. This cap 18 is for surrounding the dispensing opening 15, and it has a coaxial aperture 20.

The first threads 16 are mounted on a container closure 22 which may be secured to the container 14 by releasable means such as threads 23. Therefore the dispensing opening 15 may be a spout as shown in FIG. 4 and as attached to the container 14. These cooperable threads are part of a valve structure 25 which includes first and second parts 26 and 27, respectively. The first valve part 26 includes the coaxial aperture 20 on the cap 18, and the second valve part 27 includes a coaxial stem 28 mounted on the spout-like dispensing opening 15. FIG. 1 shows the dispensing opening closed by the coaxial stem 28 fitting closely within the coaxial aperture 20. FIG. 2 shows the valve being completely opened by the brush body 11 being unscrewed at the threads 16, 17 so that the brush body is moved axially upwardly, and there is an opening between the coaxial stem 28 and the coaxial aperture 20. The first and second threads 16 and 17 are double threads so that a 180° rotation in the loosening direction of the threads from FIG. 1 to FIG. 2 establishes one thread pitch of axial movement in the opening direction. There is a rotation stop 29 which limits the rotational movement of the brush applicator 10 to about 180° of rotation establishing the fully-opened position of FIG. 2. When the threads are tightened, this effects a fluid seal between the brush bristles 12 and the dispensing opening 15. Any position of the brush applicator between that shown in FIGS. 1 and 2 will permit variable fluid flow from the container into the brush applicator 10.

This brush applicator and container combination may be used to dispense fluid products such as ketchup or barbecue sauce. With the brush applicator in the position shown in FIG. 2, a lateral force 30 may be applied to the side of body 11 near the bristle end, and cause the brush applicator to snap off the container due to deformation of one or both of the threads 16 and 17. This permits ready mounting of the brush applicator onto the container 14 and when separated, permits washing of the brush applicator for clean conditions. The cap may be installed on the container as shown in the exploded view of FIG. 4 to close this container when the brush applicator is not installed.

The flow of fluid from the coaxial aperture 20 flows up into a second coaxial aperture 31 leading up into the brush bristles 12. The FIG. 5 best shows the fact that the cap 18 is secured in the brush body 11. This may be accomplished by an adhesive which secures the outer conical surface of the cap 18 to a complementary conical surface on the interior of the brush body 11. This makes a unitized brush applicator of the body 11 and cap 18.

The container 14 is preferably deformable, such as a squeeze bottle so that pressure may be applied easily to the fluid product to force it out of the dispensing opening 15 into the brush applicator 10 when the valve is opened as in FIG. 2.

The brush applicator may be constructed in any manner such as a paintbrush-type of manufacture using fused nylon-to-bristle technology, or it can be made by staple-set technology or any other brush manufacturing process. The dispensing opening 15 need not be on a spout with the valve seal being between a coaxial aperture 20 and a coaxial stem 28, although this provides a convenient spout-type of dispensing into the brush applicator 10.

Figure 3:
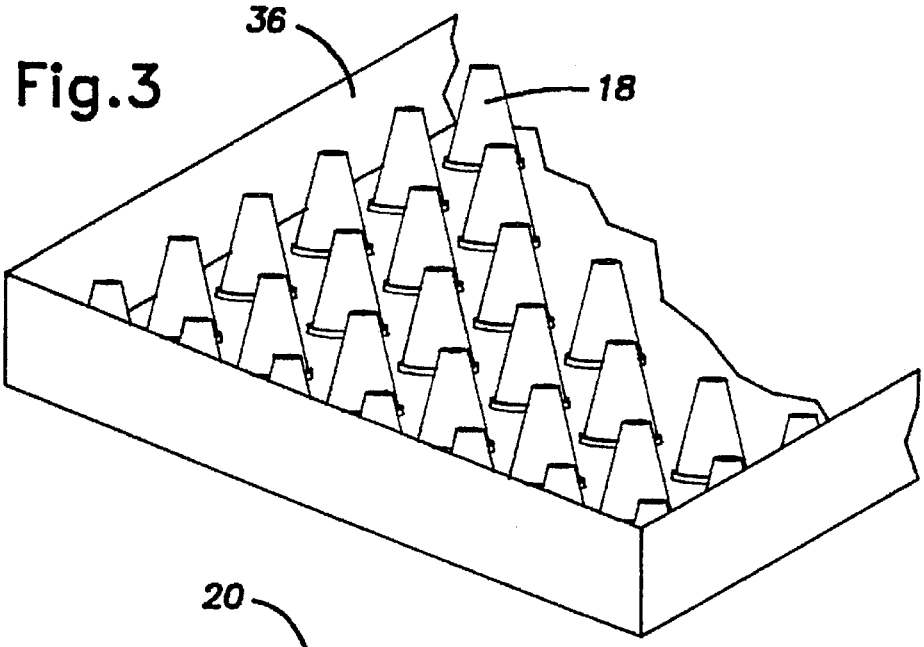
FIG. 3 is an isometric view of a shipping tray with only caps therein.

The invention is further defined by the method of making a valved brush applicator 10 for a container 14 which is closable by the cap 18. This method includes the steps of taking delivery of only the caps 18 from someone such as the manufacture, the distributor or wholesaler of the caps and usually the caps and containers. This taking of delivery is illustrated in FIG. 3 by a shipping tray 36 containing a plurality of just the caps 18. The recipient of the caps may manufacture or have manufactured a brush applicator 10 with a brush body 11, with bristles 12 in one axial end and a cap recess 37 in the other end. This cap recess is conical and complementary to the outer surface of the cap 18. The cap and the brush body 11 are united, for example, by an adhesive, and the various parts are made preferably from suitable plastic material. Where the fused nylon technique is used, a rod may be placed coaxially in a mold to keep open the coaxial aperture 20 and to form the second coaxial aperture 31 in the base of the bristles, at the time of molding the body 11, and the fusing of the bristles. After the cap is united with the brush body 11, the completed brush applicator 10 with brush body 11, bristles 12 and cap 18 are shipped to a purchaser. This purchaser may be the same entity from which there was a taking of delivery of the caps 18.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

I claim:

1. A container for a fluid product, the container including a brush applicator and having a stem which defines a radial dispensing opening, said stem having first threads formed thereon which mesh with second threads provided by said brush applicator, said brush applicator including a brush body and a cap, said brush body having bristles extending therefrom and defining a passageway in which the cap is received, said passageway issuing into said bristles, said cap radially surrounding said dispensing opening and including said second threads, said second threads cooperating with the first threads as part of a valve structure which also includes the cap and the stem, whereby tightening of the threads effects a fluid seal between said cap and said stem to prevent fluid flow through said dispensing opening, and loosening said threads separates said cap from said stem sufficiently to allow variable fluid flow from the container, through the dispensing opening and passageway and into said bristles, said brush body being affixed to said cap and said brush applicator being removably secured to said stem and adapted to be snapped on and off the container by deformation of at least one of said first and second threads.

2. A brush applicator as set forth in claim 1, wherein said first threads are formed on an external surface of said stem.

3. A brush applicator as set forth in claim 1, wherein said stem is coaxial with said passageway and provides a plurality of dispensing openings.

4. A brush applicator and container, said container having a stem with a radial dispensing opening for a fluid product, wherein the brush applicator is usable as an applicator for the fluid product and the combination of the applicator and container provide an openable and closeable valve structure to alternatively open or seal off flow of the fluid product through said dispensing opening; said valve structure including first and second cooperable valve parts;

said first valve part including a cap having an aperture;

cooperating threads on said first and second valve parts such that tightening of the threads effects a fluid seal between said cap and said stem, and loosening said threads separates said cap and said stem sufficiently to allow fluid flow from said container dispensing opening into said brush applicator;

said brush applicator comprising said cap and a brush body, said brush body having a passageway formed therein which receives said cap and having bristles extending therefrom, said dispensing opening being in fluid communication with said bristles via said aperture and passageway to permit fluid flow from said container to said brush bristles;

at least one of said cooperating threads being deformable, whereby said cap and brush body are snapped on and off the container stem as a unit.

5. A brush applicator and container combination as set forth in claim 4, wherein said cooperating threads are double threads for increased longitudinal movement of said cap for a given rotational movement.

6. A brush applicator and container combination as set forth in claim 4, wherein said stem is coaxial with said passageway and aperture, and said stem comprises said second valve part.

* * * * *